United States Patent [19]

Charlesworth et al.

[11] 4,427,958

[45] Jan. 24, 1984

[54] TELEPHONE TRANSDUCERS

[75] Inventors: David V. Charlesworth, Seaford; Derek F. Smith, Shoreham by Sea, both of England

[73] Assignee: A. P. Besson Limited, East Sussex, England

[21] Appl. No.: 417,952

[22] Filed: Sep. 14, 1982

[30] Foreign Application Priority Data

Sep. 16, 1981 [GB] United Kingdom ..... 8127961

[51] Int. Cl.[3] ..... H01F 7/00

[52] U.S. Cl. ..... 335/231; 179/179

[58] Field of Search ..... 335/231; 179/114 R, 179/115 R, 115.5 ES, 146, 178, 179, 181; 29/602 A

[56] References Cited

U.S. PATENT DOCUMENTS 3,692,264 9/1972 Burkhard et al. ..... 179/179

3,947,647 3/1976 Swinehart ..... 179/179

*Primary Examiner*—George Harris

*Attorney, Agent, or Firm*—Pollock, Vande Sande & Priddy

[57] ABSTRACT

An acoustic transducer of novel structure suitable for automatic assembly is made by arranging with its wall upwards a generally cup-shaped rear cover having a cylindrical wall out-turned at its upper end and extending from the rim of a base divided along a chord into a major segment for receiving an electromagnetic driving unit and a terminal receiving minor segment at a higher vertical level than the major segment. The major segment has on its inner face fixing lands disposed symmetrically with respect to a diameter normal to said chord offset away from the minor segment and extending inwards from the side wall. Each fixing land is formed to define a fixing location and having on its face presented to the minor segment an upstanding locator wall.

14 Claims, 3 Drawing Figures

TELEPHONE TRANSDUCERS

A yoke and coil sub-assembly lowered into the rear cover is defined by a cruciform yoke plate of magnetizable material having a magnet at its center with one pair of upturned opposite arms directed along the diameter normal to said chord the said pair of arms defining pole pieces and carrying coils and with the other pair of upturned opposite arms parallel to the said chord and formed with outturned fixing ears that settle directly on said lands behind said locator wall with through-holes therein aligning with said fixing locations of said lands.

Onto the yoke and coil sub-assembly is placed downwardly on armature formed with depending bearing means that settle on the magnet and permit the armature to rock thereon and a pair of torsion arms extending towards the lands and terminating in fixing ears that settle behind the locator wall on the fixing ears of the coil sub-assembly with through-holes aligning with said fixing locations of said lands. The armature has secured thereto an upstanding connecting rod. The armature is mechanically fixed from above the rear cover in tight contact with the yoke plate and the yoke plate is fixed in tight contact with the lands so that the armature is supported for vibration in said rear cover. Connector terminals are introduced through said minor segment and electrically connected to the coils. A dished diaphragm is placed downward onto the rear cover so that its rim settles on the out-turned end of the cylindrical wall and the connecting rod projects through a through-hole in said diaphragm. Then the connecting rod is adhered to the diaphragm and a front cover is assembled to the rear cover.

FIELD OF THE INVENTION

The present invention relates to an electro-acoustic transducer particularly, though not exclusively, intended for telephones and in particular to a telephone receiver of the kind designated by the British Post Office as No. 3 or No. 4. These are symmetrical transducer systems and may thus be used equally as microphones (transmitters).

BACKGROUND TO THE INVENTION

Conventionally the No. 4 receiver has a metal front and rear cover. Inside the front cover is a membrane that excludes moisture, a damping disc and a frustoconical diagraphm. A connecting rod fixed to the diaphragm is connected at its other end to the rocking armature of an electromagnetic driving system that includes a pair of series-wound coils between which is located a permanent magnet and a yoke of soft magnetic material that passes into the coils and also provides a fixing for the driving system. The driving system and electrical connections for the coils are secured to an annular metal frame that fits into the front cover behind the diaphragm and which provides a seating for the rear cover which is crimped or spun over the front cover. The construction of the No. 3 receiver is similar but includes no membrane or separate damping disc. The frame that carries the driving system accounts for a considerable proportion of the cost of the transducer.

SUMMARY OF THE INVENTION

It is an object of the invention to provide a transducer assembly that is less expensive and is simple to assemble. It is also an object of the invention to provide an insulating housing for the transducer that provides additional subscriber protection from high energy transients in the telephone system, e.g. as a result of electrical storms.

The invention provides an electro-acoustic transducer comprising:

a generally cup-shaped rear cover having a cylindrical wall out-turned at its upper end and extending from the rim of a base divided at a chord into a major segment for receiving an electromagnetic driving unit and at a higher level than the major segment a terminal-receiving minor segment, the major segment having on its inner face fixing lands disposed symmetrically with respect to a diameter normal to said chord, offset away from the minor segment and extending inwards along the side wall, each fixing land being formed to define a fixing location and having on its face presented to the minor segment an upstanding locator wall;

a yoke and coil sub-assembly defined by a cruciform yoke plate of magnetizable material having a magnet at its center with one pair of upturned opposite arms directed along the diameter normal to said chord to define pole pieces that carry coils and with the other pair of upturned opposite arms parallel to the said chord and formed with out-turned fixing ears that locate directly on said lands behind the locator wall with through-holes therein aligning with said fixing locations of said lands;

an armature overlying said yoke and formed with depending bearing means engaging said magnet to permit the armature to rock thereon and a pair of torsion arms extending towards the lands and terminating in fixing ears in contact with the fixing ears of the yoke with through-holes therein aligning with said fixing locations of said lands, said armature having secured thereto an upstanding connecting rod;

means fixing the armature in tight contact with the yoke and the yoke in tight contact with the lands so that the armature is supported for vibration in said rear cover;

connector terminals extending through said minor segment and electrically connected to the coils;

a dished diaphragm connected generally at its center to the connecting rod and supported at its periphery on the out-turned rim of the cylindrical wall; and a front cover engaged with the rear cover to define a transducer housing.

The invention further provides a method for making an electro-acoustic transducer which comprises:

arranging with its wall upwards a generally cup-shaped rear cover having a cylindrical wall out-turned at its upper end and extending from the rim of a base divided along a chord into a major segment for receiving an electromagnetic driving unit and a terminal receiving minor segment at a higher vertical level than the major segment, the major segment having on its inner face fixing lands disposed symmetrically with respect to a diameter normal to said chord offset away from the minor segment and extending inwards from the side wall, each fixing land being formed to define a fixing location and having on its face presented to the minor segment an upstanding locator wall;

placing downwards into the rear cover a yoke and coil sub-assembly defined by a cruciform yoke plate of magnetizable material having a magnet at its center with one pair of upturned opposite arms directed along the diameter normal to said chord, the said pair of arms defining pole pieces and carrying coils, and with the other pair of upturned opposite arms parallel to the said chord and formed with outturned fixing ears that settle directly on said lands behind said locator wall with through-holes therein aligning with said fixing locations of said lands;

placing downwardly into the rear cover an armature formed with depending bearing means that settle on the magnet and permit the armature to rock thereon and a pair of torsion arms extending towards the lands and terminating in fixing ears that settle behind the locator wall on the fixing ears of the coil sub-assembly with through-holes aligning with said fixing locations of said lands, said armature having secured thereto an upstanding connecting rod;

mechanically fixing the armature from above the rear cover in tight contact with the yoke plate and the yoke plate in tight contact with the lands so that the armature is supported for vibration in said rear cover;

introducing connector terminals through said minor segment and electrically connecting the coils to the terminals;

placing downwards onto the rear cover a dished diaphragm so that its rim settles on the out-turned end of the cylindrical wall and the connecting rod projects through a through-hole in said diaphragm;

adhering the connecting rod to the diaphragm; and assembling a front cover to the rear cover.

BRIEF DESCRIPTION OF THE DRAWINGS

An embodiment of the invention will now be described by way of example with reference to the accompanying drawings in which.

DESCRIPTION OF THE PREFERRED EMBODIMENT

Figure 1:
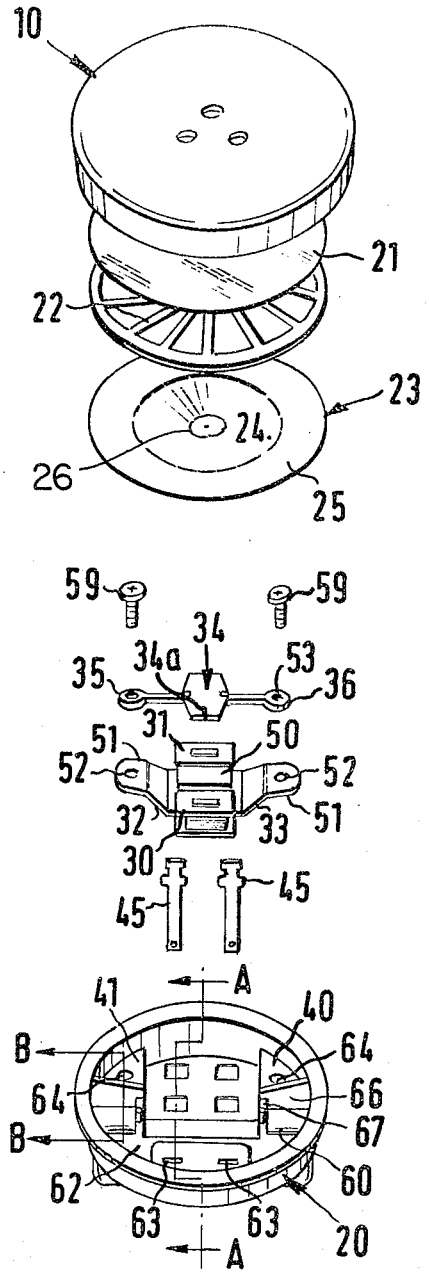
FIG. 1 is an exploded view of an acoustic transducer according to the invention.
Figure 2:
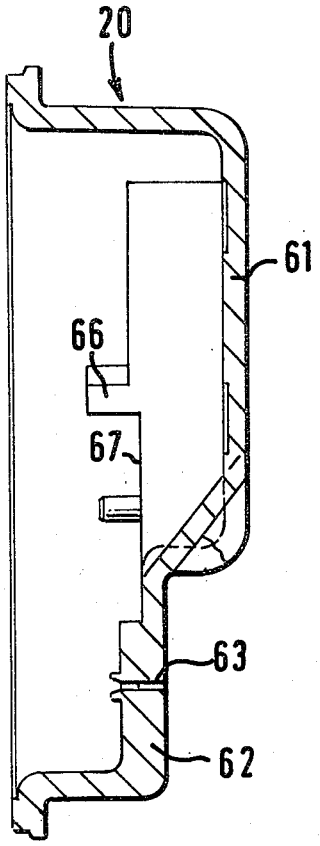
FIG. 2 is a vertical section of the rear cover on the line A—A of FIG. 1.
Figure 3:
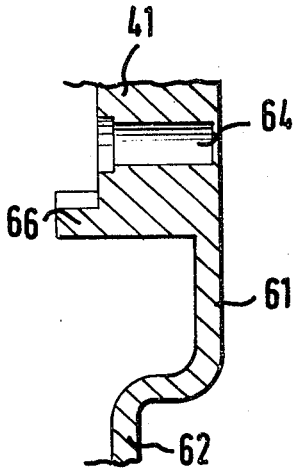
FIG. 3 is a vertical section of the rear cover on the line B—B of FIG. 1.

In FIG. 1 a front cover generally designated by the reference numeral 10 is a snap fit over a rear cover generally designated by reference numeral 20. Ultrasonic welding, solvent welding or adhesive bonding could also be used. Both are moulded in a plastics material such as ABS, nylon or an acetal copolymer or may be a metal such as aluminum. For user protection it is preferred that the front cover should be of a plastics material. Behind the front cover 10 is a membrane 21 of thin plastics sheet that prevents ingress of moisture into the interior of the transducer and a damping disc 22 that may be of metal or plastics. A thin metal diaphragm 23 has an inner generally conical portion 24 and an outer circumferential land 25 that sits on the out-turned rim of the rear cover 20 and locates against the damping disc 22. One end of a connecting rod 34A (described below) passes through a central through hole 26 in the diaphragm 23 and is secured to the diaphragm 23, e.g. by a cyanoacrylate adhesive.

The driving unit comprises a so-called yoke made of soft magnetic material having a generally cruciform central baseplate to the center of which is secured a magnet 50, a first pair of upstanding arms defining pole pieces and carrying series-wound coils 30, 31 and a second pair of upstanding arms defining located members 32, 33 that have out-turned extremities 51 formed with fixing holes 52. An armature 34 overlies the magnet 50 and has stamped semi-cylindrical depressions permitting it to vibrate thereon. It is secured to the other end of the connecting rod 34 so that as it moves it actuates the diaphragm 23. The armature 34 pivots on the magnet 50 and is retained by arms acting as torsion bars whose extremities 35, 36 coincide with the extremities of the locating members 32, 33 and are likewise formed with through-holes 53.

The rear cover 20 is divided at a chord 60 into a lower major segment 61 which receives the yoke and coil assembly and the armature 34 and a minor segment 62 at an upper level that is formed with through-holes 63 for receiving connecting terminals 45. On its inner face the rear cover 20 is formed with fixing lands 40, 41 disposed symmetrically with respect to a diameter normal to the chord 60 and offset away from the minor segment 62 and extending inwards from the side wall. Each fixing land is formed with a hole 64 opening to the upper face thereof that defines a fixing location and an upstanding locator wall 66 on its edge presented to the minor segment 62. Reinforcing ribs 67 between the minor segment 62 and the medial edge of each land directed generally normal to the chord 60 damp out an unwanted resonance at 2000–2500 Hz. Electrical connections are provided between the coils 30, 31 and terminals 45 in through-holes 63.

The rear cover 20 is of overall diameter about 37.8 mms or about 43.8 mms, and the fixing locations (holes 64) of said fixing lands 40, 41 are spaced about 25.4 mms apart.

In assembly the rear cover 20 is arranged with its rim upwardly as shown and an assembly of yoke, magnet 50 and coils 31, 32 is lowered until the extremities of arms 32, 33 settle on the lands 40, 41 behind the locator walls 66 with the holes 52 and 64 in register. Then the armature 34 is lowered in place and fixing screws 59 engaged in the holes 52, 53 and 64 are simultaneously and equally tightened from above by automatic screwdrivers thereby clamping the armature 34 in tight contact with the extremities 51 of the yoke plate so that the armature 34 is supported for vibration in the cover 20. The terminals 45 are inserted downwardly into the holes 63 and connecting leads from the coils 30, 31 are attached thereto. The diaphragm 23 is then lowered into place with the connecting rod 34A protruding from the central through-hole therein and with its rim having settled on the out-turned rim of the cylindrical wall of the rear cover 20. The connecting rod and diaphragm are then adhered by application of a spot of ultraviolet activated adhesive followed by passage through an ultraviolet light chamber. Other forms of adhesive such as two-component adhesives may be used as alternatives. Thereafter the damping disc 22 and membrane 21 are lowered into position and finally the top cover 10 is assembled to the rear cover 20. It will be appreciated that this arrangement is advantageous insofar as all the parts are placed serially in or on the rear cover and is very suitable for automatic assembly.

It will be appreciated that various modifications may be made to the embodiment described above without departing from the invention, the scope of which is defined in the appended claims. For example, the electromagnetic drive unit may be formed with depending pegs that locate in holes in the lands 40, 41, or the electromagnetic drive unit may locate on threaded pegs upstanding from lands 40, 41 and held in place by clamping nuts, or the lands 40, 41 may be formed with upstanding deformable pegs on which the electromagnetic drive unit locates, after which the pegs are swaged over to hold the unit in place.

We claim:

1. A method for making an electro-acoustic transducer which comprises:

arranging with its wall upwards a generally cup-shaped rear cover having a cylindrical wall outturned at its upper end and extending from the rim of a base divided along a chord into a major segment for receiving an electromagnetic driving unit and a terminal receiving minor segment at a higher vertical level than the major segment, the major segment having on its inner face fixing lands disposed symmetrically with respect to a diameter normal to said chord offset away from the minor segment and extending inwards from the side wall, each fixing land being formed to define a fixing location and having on its face presented to the minor segment an upstanding locator wall;

placing downwards into the rear cover a yoke and coil sub-assembly defined by a cruciform yoke plate of magnetizable material having a magnet at its center with one pair of upturned opposite arms directed along the diameter normal to said chord, the said pair of arms defining pole pieces and carrying coils, and with the other pair of upturned opposite arms parallel to the said chord and formed with outturned fixing ears that settle directly on said lands behind said locator wall with through-holes therein aligning with said fixing locations of said lands;

placing downwardly into the rear cover an armature formed with depending bearing means that settle on the magnet and permit the armature to rock thereon and a pair of torsion arms extending towards the lands and terminating in fixing ears that settle behind the locator wall on the fixing ears of the coil sub-assembly with through-holes aligning with said fixing locations of said lands, said armature having secured thereto an upstanding connecting rod;

mechanically fixing the armature from above the rear cover in tight contact with the yoke plate and the yoke plate in tight contact with the lands so that the armature is supported for vibration in said rear cover;

introducing connector terminals through said minor segment and electrically connecting the coils to the terminals;

placing downwards onto the rear cover a dished diaphragm so that its rim settles on the out-turned end of the cylindrical wall and the connecting rod projects through a through-hole in said diaphragm;

adhering the connecting rod to the diaphragm; and assembling a front cover to the rear cover.

2. A method according to claim 1 wherein the rear cover is provided with upstanding reinforcing ribs between the minor segment and each fixing land directed parallel to said diameter for avoiding an unwanted resonance in the frequency range 2000–2500 Hz.

3. A method according to claim 2 wherein the rear cover is of overall diameter about 37.8 mms or about 43.8 mms and the fixing locations of said lands are spaced about 25.4 mms apart.

4. A method according to claim 1 wherein the front and rear covers are mouldings in nylon, ABS, an acetal copolymer or another plastics material.

5. A method according to claim 1 wherein the armature and the yoke and coil sub-assembly are secured by screws passed downwards through the through-holes and threadedly received in the fixing lands.

6. A method according to claim 1 wherein the extremities of the armature have depending fixing pegs that pass through the through-holes in the yoke and are an interference fit in holes in the fixing lands.

7. A method according to claim 1 wherein the fixing lands are formed with upstanding threaded studs that locate in through-holes in the extremities of the yoke and the armature, clamping nuts holding the yoke and the armature in place.

8. A method according to claim 1 wherein the fixing lands are formed with upstanding studs that locate in through-holes in the extremities of the yoke and the armature after which they are swaged to clamp the yoke and armature in place.

9. A method according to claim 1 wherein the connector terminals are in the form of connector tags or threaded studs and are forced from above into through-holes in the minor segment in which they fit.

10. An electro-acoustic transducer comprising:

a generally cup-shaped rear cover having a cylindrical wall out-turned at its upper end and extending from the rim of a base divided at a chord into a major segment for receiving an electromagnetic driving unit and, at a higher level than the major segment, a terminal receiving minor segment, the major segment having on its inner face fixing lands disposed symmetrically with respect to a diameter normal to said chord, offset away from the minor segment and extending inwards along the side wall, each fixing land being formed to define a fixing location and having on its face presented to the minor segment an upstanding locator wall;

a yoke and coil sub-assembly defined by a cruciform yoke plate of magnetizable material having a magnet at its center with one pair of upturned opposite arms directed along the diameter normal to said chord to define pole pieces that carry coils and with the other pair of upturned opposite arms parallel to the said chord and formed with out-turned fixing ears that locate directly on said lands behind the locator wall with through-holes therein aligning with said fixing locations of said lands;

an armature overlying said yoke and formed with depending bearing means engaging said magnet to permit the armature to rock thereon and a pair of torsion arms extending towards the lands and terminating in fixing ears in contact with the fixing ears of the yoke with through-holes therein aligning with said fixing locations of said lands, said armature having secured thereto an upstanding connecting rod;

means fixing the armature in tight contact with the yoke and the yoke in tight contact with the lands so that the armature is supported for vibration in said rear cover;

connector terminals extending through said minor segment and electrically connected to the coils;

a dished diaphragm connected generally at its center to the connecting rod and supported at its periphery on the out-turned rim of the cylindrical wall; and a front cover engaged with the rear cover to define a transducer housing.

11. A transducer according to claim 10 wherein the rear cover is provided with upstanding reinforcing ribs between the minor segment and each fixing land directed normal to said chord for avoiding an unwanted resonance in the frequency range 2000–2500 Hz.

12. A transducer according to claim 10 wherein the rear cover is of overall diameter about 37.8 mms or about 43.8 mms and the fixing locations of said lands are spaced about 25.4 mms apart.

13. A transducer according to claim 10 wherein the front and rear covers are mouldings in nylon, ABS, an acetal copolymer or another mouldable plastics material.

14. A transducer according to claim 10 wherein screws pass through the through-holes in the yoke and in the armature and are threadedly received in the fixing lands.

* * * * *